US009466872B2

(12) United States Patent
Sanchez et al.

(10) Patent No.: US 9,466,872 B2
(45) Date of Patent: Oct. 11, 2016

(54) TUNABLE DUAL LOOP ANTENNA SYSTEM

(71) Applicant: Futurewei Technologies, Inc., Plano, TX (US)

(72) Inventors: Jorge Fabrega Sanchez, San Diego, CA (US); Kiran Vanjani, San Diego, CA (US)

(73) Assignee: Futurewei Technologies, Inc., Plano, TX (US)

( * ) Notice: Subject to any disclaimer, the term of this patent is extended or adjusted under 35 U.S.C. 154(b) by 302 days.

(21) Appl. No.: 13/907,120

(22) Filed: May 31, 2013

(65) Prior Publication Data

US 2014/0132465 A1 May 15, 2014

Related U.S. Application Data

(63) Continuation-in-part of application No. 13/673,862, filed on Nov. 9, 2012, now abandoned.

(60) Provisional application No. 61/780,081, filed on Mar. 13, 2013.

(51) Int. Cl.

| | |
|---|---|
| ***H01Q 7/00*** | (2006.01) |
| ***H01Q 21/28*** | (2006.01) |
| ***H01Q 21/30*** | (2006.01) |
| ***H01Q 1/24*** | (2006.01) |
| ***H01Q 1/36*** | (2006.01) |

(52) U.S. Cl.

CPC ..... *H01Q 1/243* (2013.01); *H01Q 1/36* (2013.01); *H01Q 7/00* (2013.01); *H01Q 21/28* (2013.01); *H01Q 21/30* (2013.01)

(58) Field of Classification Search

None

See application file for complete search history.

(56) References Cited

U.S. PATENT DOCUMENTS

| | | | | |
|---|---|---|---|---|
| 3,390,394 | A | 6/1968 | Reinhold | |
| 8,532,675 | B1 | 9/2013 | Pasquero et al. | |
| 8,648,756 | B1 * | 2/2014 | Desclos | H01Q 5/335 343/702 |
| 2001/0036813 | A1 | 11/2001 | Baker et al. | |

(Continued)

FOREIGN PATENT DOCUMENTS

| | | |
|---|---|---|
| CN | 1220525 A | 6/1999 |
| CN | 1774871 A | 5/2006 |

(Continued)

OTHER PUBLICATIONS

Ren et al, Antenna Aims At Dual Bands, Oct. 2012 http://mwrf.com/passive-components/antenna-aims-dual-bands.*

(Continued)

*Primary Examiner* — Ping Hsieh
*Assistant Examiner* — James Yang
(74) *Attorney, Agent, or Firm* — Conley Rose, P.C.; Grant Rodolph; William H. Dietrich

(57) ABSTRACT

An apparatus comprising a first antenna, a second antenna, wherein the first antenna and the second antenna comprise a common conductor, a variable load connected between the common conductor and a ground connection, wherein an impedance of the variable load is variable, and wherein an operating frequency of the first antenna and the second antenna depends on the impedance, and a selection switch coupled to the first antenna and the second antenna, wherein the selection switch is configured to activate the first antenna and deactivate the second antenna in a first state, and wherein the selection switch is configured to activate the second antenna and deactivate the first antenna in a second state.

20 Claims, 16 Drawing Sheets

(56) References Cited

U.S. PATENT DOCUMENTS

| | | | | |
|---|---|---|---|---|
| 2003/0108976 | A1 | 6/2003 | Braig et al. | |
| 2004/0208333 | A1 | 10/2004 | Cheung et al. | |
| 2005/0153673 | A1* | 7/2005 | Ohsuge | 455/272 |
| 2006/0019630 | A1 | 1/2006 | Sposato et al. | |
| 2006/0240866 | A1* | 10/2006 | Eilts | 455/556.1 |
| 2007/0069721 | A1 | 3/2007 | Honkura et al. | |
| 2008/0291111 | A1* | 11/2008 | Bae et al. | 343/860 |
| 2009/0207093 | A1* | 8/2009 | Anreddy et al. | 343/876 |
| 2009/0295648 | A1 | 12/2009 | Dorsey et al. | |
| 2010/0085724 | A1 | 4/2010 | Park et al. | |
| 2010/0285759 | A1 | 11/2010 | Chung et al. | |
| 2010/0304757 | A1 | 12/2010 | Yoshioka | |
| 2011/0001676 | A1* | 1/2011 | Friman et al. | 343/745 |
| 2011/0063180 | A1 | 3/2011 | Su | |
| 2012/0299772 | A1 | 11/2012 | Shtrom et al. | |
| 2013/0040601 | A1 | 2/2013 | Oh | |
| 2013/0182867 | A1 | 7/2013 | Knowles | |
| 2013/0321230 | A1* | 12/2013 | Merlin et al. | 343/787 |

FOREIGN PATENT DOCUMENTS

| | | | |
|---|---|---|---|
| CN | 1820179 | A | 8/2006 |
| CN | 101834643 | A | 9/2010 |
| CN | 201830328 | U | 5/2011 |
| EP | 1261126 | A2 * | 11/2002 |

OTHER PUBLICATIONS

"SAR Evaluation Report for iPhone," FCC OET Bulletin 65 Supplement C 01-01 IEEE STD 1528:2003, Compliance Certification Services (UL CCS), Report No. 11U13896-5B, Oct. 1, 2011, 95 pages.

Caimi, F.M., et al., "Isolated Mode Antenna Technology," iMat, Skycross, Inc., Jan. 2008, 9 pages.

Li, W-Y., et al., "Seven-Band Surface-Mount loop Antenna With a Capacitively Coupled Feed for Mobile Phone Application," Microwave and Optical Technology Letters, vol. 51, No. 1, Jan. 2009, pp. 81-88.

Su, S-W., et al., "Dual-Polarized Dual-Loop-Antenna System for 2.4/5 GHz WLAN Access Points," IEEE 2011, pp. 24-28.

Foreign Communication From a Counterpart Application, PCT Application No. PCT/CN2013/086846, International Search Report dated Jan. 23, 2014, 6 pages.

Foreign Communication From a Counterpart Application, PCT Application No. PCT/CN2013/086846, Written Opinion dated Jan. 23, 2014, 6 pages.

Foreign Communication From a Counterpart Application, PCT Application No. PCT/CN2013/086764, International Search Report dated Feb. 13, 2014, 6 pages.

Foreign Communication From a Counterpart Application, PCT Application No. PCT/CN2013/086764, Written Opinion dated Feb. 13, 2014, 5 pages.

Office Action dated Nov. 5, 2014, 24 pages, U.S. Appl. No. 13/673,862, filed Nov. 9, 2012.

Office Action dated Jul. 7, 2014, 20 pages, U.S. Appl. No. 13/673,862, filed Nov. 9, 2012.

Office Action dated Nov. 7, 2013, 22 pages, U.S. Appl. No. 13/673,835, filed Nov. 9, 2012.

Notice of Allowance dated Feb. 19, 2014, 7 pages, U.S. Appl. No. 13/673,835, filed Nov. 9, 2012.

Notice of Allowance dated May 22, 2014, 11 pages, U.S. Appl. No. 13/673,835, filed Nov. 9, 2012.

* cited by examiner

TUNABLE DUAL LOOP ANTENNA SYSTEM

CROSS-REFERENCE TO RELATED APPLICATIONS

The present application claims priority to U.S. Provisional Patent Application No. 61/780,081 filed Mar. 13, 2013 by Jorge Fabrega Sanchez, et al. and entitled "Tunable Dual Loop Antenna System" and it is a continuation-in-part of U.S. patent application Ser. No. 13/673,862 filed Nov. 9, 2012 by Jorge Fabrega Sanchez, et al. and entitled "Dual Feed Antenna System", which are incorporated herein by reference as if reproduced in their entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Advances in wireless communication have revolutionized the way we communicate and access information, and have birthed a variety of wireless capable consumer devices. In modern wireless communication systems, a variety of input/output (I/O) components and user interfaces are used in a wide variety of electronic devices. Portable wireless communication devices such as a smartphone increasingly integrate a number of functionalities (e.g., global positioning system (GPS), wireless local area networks (WLAN or Wi-Fi), Bluetooth, cellular communication, near field communication (NFC), etc.).

An antenna can be used to transmit or receive radio frequency (RF) signals in the range of about 3 kilohertz (KHz) to 300 gigahertz (GHz). Cellular communications within the United States generally use a frequency range between 698 and 5000 megahertz (MHz). Modern wireless communication devices use numerous types of antennas, including dipole antennas (e.g., short dipole, half-wave dipole, folded dipole, broadband dipoles), monopole antennas, small loop antennas, rectangular microstrip (or patch) antennas, planar inverted-F antennas (PIFA), helical antennas, spiral antennas, slot antennas, cavity-backed slot antennas, inverted-F antennas (IFA), slotted waveguide antennas, and near field communications (NFC) antennas, including various combinations thereof.

SUMMARY

In one embodiment, the disclosure includes an apparatus comprising a first antenna, a second antenna, wherein the first antenna and the second antenna comprise a common conductor, a variable load connected between the common conductor and a ground connection, wherein an impedance of the variable load is variable, and wherein an operating frequency of the first antenna and the second antenna depends on the impedance, and a selection switch coupled to the first antenna and the second antenna, wherein the selection switch is configured to activate the first antenna and deactivate the second antenna in a first state, and wherein the selection switch is configured to activate the second antenna and deactivate the first antenna in a second state.

In another embodiment, the disclosure includes a wireless communication device comprising a first antenna, a second antenna, wherein the first antenna and the second antenna comprise a common conductor, a variable load connected between the common conductor and a ground connection, wherein an impedance of the variable load is variable, and wherein an operating frequency of the first antenna and the second antenna depends on the impedance, a selection switch coupled to the first antenna and the second antenna, wherein the selection switch is configured to activate only the first antenna in a first state and activate only the second antenna in a second state, and a processor coupled to the variable load and the selection switch, wherein the processor is configured to set a state of the selection switch from among the first state and the second state based on an orientation of the wireless communication device, select a first operating frequency band, and set the impedance to a value to achieve the first operating frequency band.

In yet another embodiment, the disclosure includes a method for operating a wireless communication device comprising a first antenna, a second antenna, and a variable load, wherein the first antenna and the second antenna share a common conductor, and wherein the variable load is directly connected to the common conductor, the method comprising determining an orientation of the wireless communication device, determining an operating frequency band, activating only one of the first antenna or the second antenna based on at least one of the operating frequency band and the orientation, and adjusting an impedance of a variable load in accordance with the operating frequency band.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
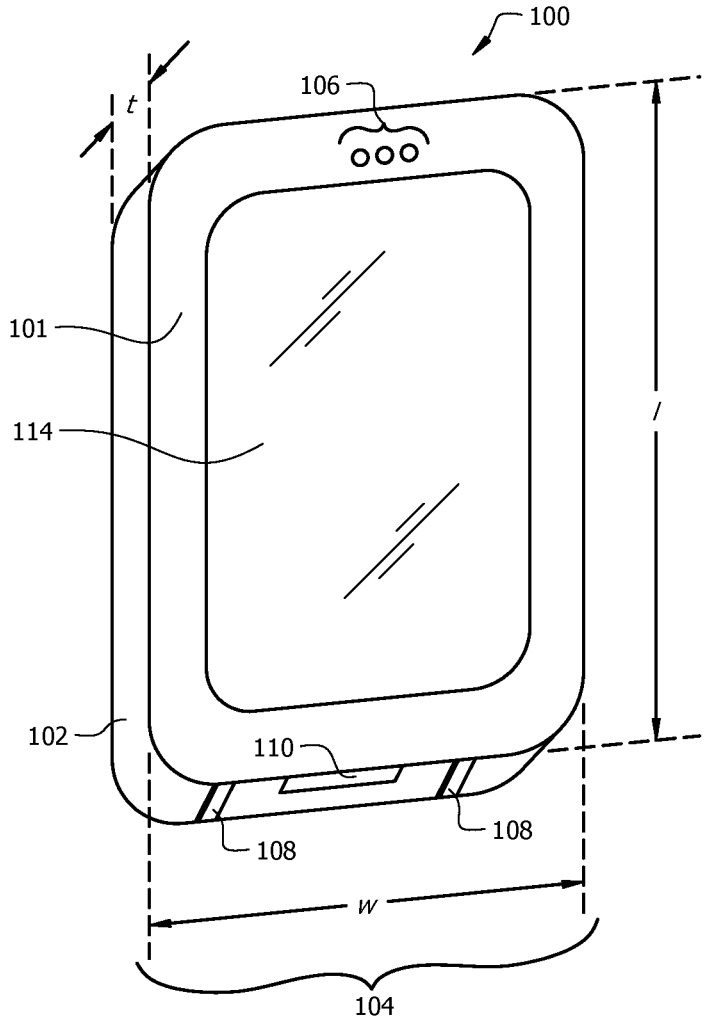
FIG. 1 is a front perspective view of an embodiment of a handheld wireless communication device.

It should be understood at the outset that although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Signal obstruction degrades wireless communication device transmission efficiency. This disclosure includes systems and methods for switching between opposing antennas sharing an overlapping frequency band to minimize obstruction, e.g., hand and/or head obstruction, of the relevant communications signals. Systems and methods disclosed herein include an antenna configuration comprising two symmetrical antennas having a common ground which, based on external parameters, e.g., orientation of the device with respect to a user, are selectively employed for optimal transmission and/or receipt of data signals. For example, a cell phone may include two loop antennas with two distinct feed points and one common ground arranged in symmetrical configuration with respect to the length centerline of a mobile phone. When the phone is in use, the head-relative location of the device is determined and a high-side antenna is used for transmission to minimize biological occlusion of the transmitted signal. One method to estimate the head relative location of a handset is described in U.S. patent application Ser. No. 13/673,835, which is incorporated herein by reference. In some embodiments, the dual feed antenna system occupies the same volume typically occupied by only one antenna.

The system and method may be implemented in a wireless communication device used to transmit and receive radio frequency (RF) signals. The wireless communication device may be a handheld device, such as a cellular phone. The wireless communication device may be equipped with multiple-axis (multiple-dimension) input systems, such as a display, a keypad, a touch screen, an accelerometer, a gyroscopic sensor, a Global Positioning System (GPS), a microphone, and/or a wireless interface (e.g., a Wi-Fi connection and/or a telecommunications interface).

This disclosure discusses various obstruction of a wireless communication device transmission, e.g., obstruction due to a user's body, in the context of head-relative positions and cellular telephones by way of example and not of limitation. For example, the wireless communication device may comprise various types of handheld or personal devices, such as portable two-way radio transceivers (e.g., a "walkie-talkie"), cellular telephones, tablet computers, personal digital assistants (PDAs), dictaphones, global positioning system units, garage door openers, wireless computer mice, wireless keyboards, wireless computer accessories, television remote controls, wireless keys, and cordless telephones. Similarly, while references to the "head" and "hand" are used for convenience, any body part, e.g., arm, leg, etc., may be substituted as needed for a base of reference. A person having ordinary skill in the art would recognize that implementing the disclosed method in any other type of wireless communication device and using another anatomical or wireless communication device-external frame of reference is within the scope of this disclosure.

Disclosed herein is a dual loop antenna system which may be capacitively fed and may comprise a variable impedance load positioned along a common ground connection. The impedance may be varied to tune the antenna loops for various frequency ranges. Specifically, the variable impedance may tune the antenna for low frequency band transmission and/or reception. The antenna may also be coupled to various switches in various configurations to allow for varying levels of antenna tuning control as needed for specific embodiments.

FIG. 1 is a front perspective view of an embodiment of a handheld wireless communication device 100. The wireless communication device 100 may comprise a housing 101. The housing 101 may be a casing that forms the external surface of the wireless communication device 100, and comprise a plurality of edges 102 along a perimeter of the wireless communication device 100. The edges 102 may include a bottom edge 104, two side edges, and a top edge opposite to the bottom edge 104. The wireless communication device 100 may also comprise one or more I/O ports 110 that may be located on one external surface, e.g., along the edges 102, and one or more I/O apertures 106 on a front panel 114, and aperture 108 on an edge 102 of the device. The apertures 106 and 108 may support one or more speakers or microphones (not shown) that may be located inside the wireless communication device 100. The front panel 114 may comprise a touch screen panel and, optionally, a plurality of input buttons (e.g., a QWERTY keyboard). One or more input buttons (not shown) may be located on the edges 102 as well.

The shape of the housing 101 may vary according to the different designs, e.g., for different device types and/or manufacturers. The shape may be any three-dimensional shape, but is generally rectangular or cuboid. In one embodiment, the housing 101 may have a generally rectangular cuboid shape with rounded corners. The dimensions of the housing 101 may also vary. In one embodiment, the generally cuboid shape may have a thickness (t) of about 10 millimeters, length (l) of about 110 millimeters, and width (w) of about 60 millimeters. In other embodiments, the dimensions of the housing 101 may have different values but with similar ratios as above or with different ratios. For instance, the shape of the housing 101 may be longer, wider, or thicker in comparison to the dimensions above for t, l, and w. The housing 101 may be made out of various materials, which may include plastic, fiber glass, rubber, and/or other suitable materials. For portable electronics, high-strength glass, polymers, and/or optionally light-weight metals (such as aluminum) may be used as part of the housing 101 to reduce the overall weight of the device. If the front panel 114 is a touch screen panel, a polymer (such as poly(methyl methacrylate)) or high-strength glass with conductive coating may be used in the housing 101. One or more antennas may be located around the edges 102 and may be made of conductive material suitable for RF signal radiation, such as metallic material, as described in more detail below.

Figure 2:
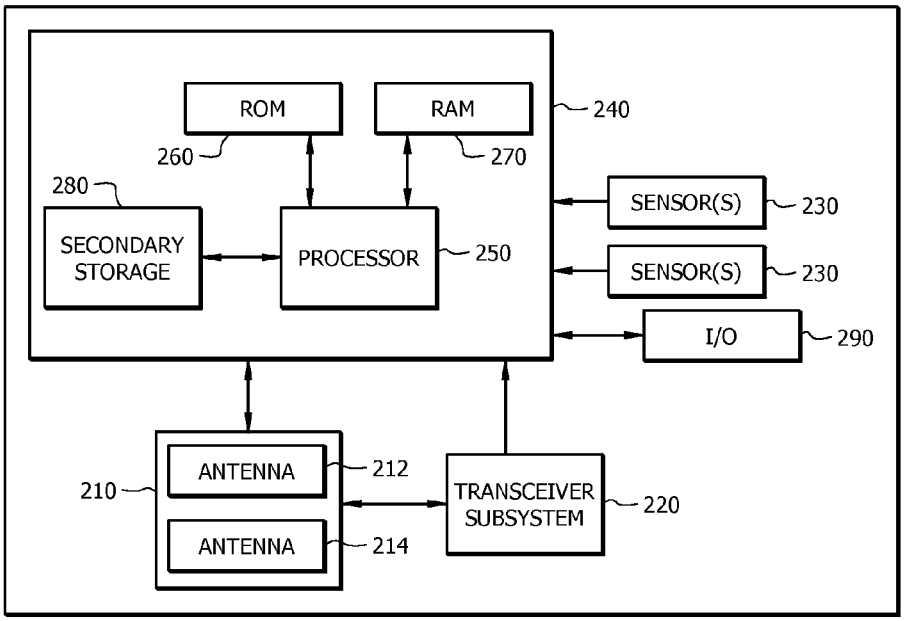
FIG. 2 is a schematic diagram of an embodiment of a wireless communication device.

FIG. 2 is schematic showing certain components comprising an embodiment of a wireless communication device 200, for example, wireless communication device 100 of FIG. 1. The wireless communication device may be a wireless phone, such as a cell phone or smart phone, or a tablet computer as examples. The wireless communication device 200 comprises an antenna subsystem 210 having antennas 212 and 214, a transceiver subsystem 220, one or more sensors 230, a processing unit 240, a processor 250, a read only memory (ROM) 260, a random-access memory (RAM) 270, a secondary storage 280, and an I/O 290 configured as shown in FIG. 2.

The antenna subsystem 210 may comprise an antenna 212 and an antenna 214, and may further comprise a switch for selecting between antennas 212 and 214. Antennas 212 and 214 may share a common ground. Antennas 212 and 214 may comprise any type of antennas that convert radio waves to electrical signals when in receive mode and/or that convert electrical signals to radio waves when in transmit mode, e.g., the antenna around edges 102 of FIG. 1. Antennas 212 and 214 may or may not be identical and/or symmetrical, and may have partially or fully overlapping communication frequency bands. In some embodiments, the antennas 212 and/or 214 may operate, for example, at one or more frequencies within the range of 824 and 2690 megahertz. However, the embodiments disclosed herein are not limited to these frequencies, but may be implemented to operate at other frequencies as well. The antenna subsystem 210 may be coupled to the transceiver subsystem 220.

The transceiver subsystem 220 may be a system that transmits digital information to and receives digital information from antenna subsystem 210 via electrical signals. The electrical signals may be centered at a specific RF, such as 1700 MHz or 2200 MHz. The transceiver subsystem 220 may comprise components for extracting digital data from an analog signal, such as a local oscillator, a modulator, and channel coder for transmission and a local oscillator, a demodulator, and channel decoder for reception. Some of these components may be implemented in a baseband processor within the transceiver subsystem 220. The transceiver subsystem 220 may compute received signal quality information, such as received signal strength indication (RSSI), and provide this information to the processing unit 240.

The processing unit 240 may be configured to receive inputs from transceiver subsystem 220, sensors 230, and I/O 290, and control a configuration of the antenna system 210, such as selecting between the antennas 212 and 214 therein. The processing unit 240 may be a separate unit from a baseband processor or may be a baseband processor itself. The processing unit 240 may include a processor 250 (which may be referred to as a central processing unit or CPU) that is in communication with memory devices including secondary storage 280, ROM 260, and RAM 270. Processor 250 may implement one or more steps similar to those in method 800 for estimating a head-relative handset location. The processor 250 may be implemented as one or more CPU chips, or may be part of one or more application specific integrated circuits (ASICs) and/or digital signal processors (DSPs). The processor 250 may access ROM 260, RAM 270, and/or secondary storage 280, which may store head-relative handset location information for a wireless communication device, to determine a desired executional configuration based on information received from n sensors, such as sensors 230.

One or more sensors 230 may be configured for determining an orientation and/or an environment of the wireless communication device 200. The orientation may be a tilt or rotation relative to a vertical direction, and the environment may be an indoor or outdoor environment, as examples. The sensors 230 may include one or more accelerometers, magnetometers, gyroscopes, tilt sensors, other suitable sensors for measuring angular orientation, a proximity sensor, or any combination or permutation thereof. Proximity sensors are well known and include optical, capacitive, ultrasonic or other proximity sensors.

Figure 3:
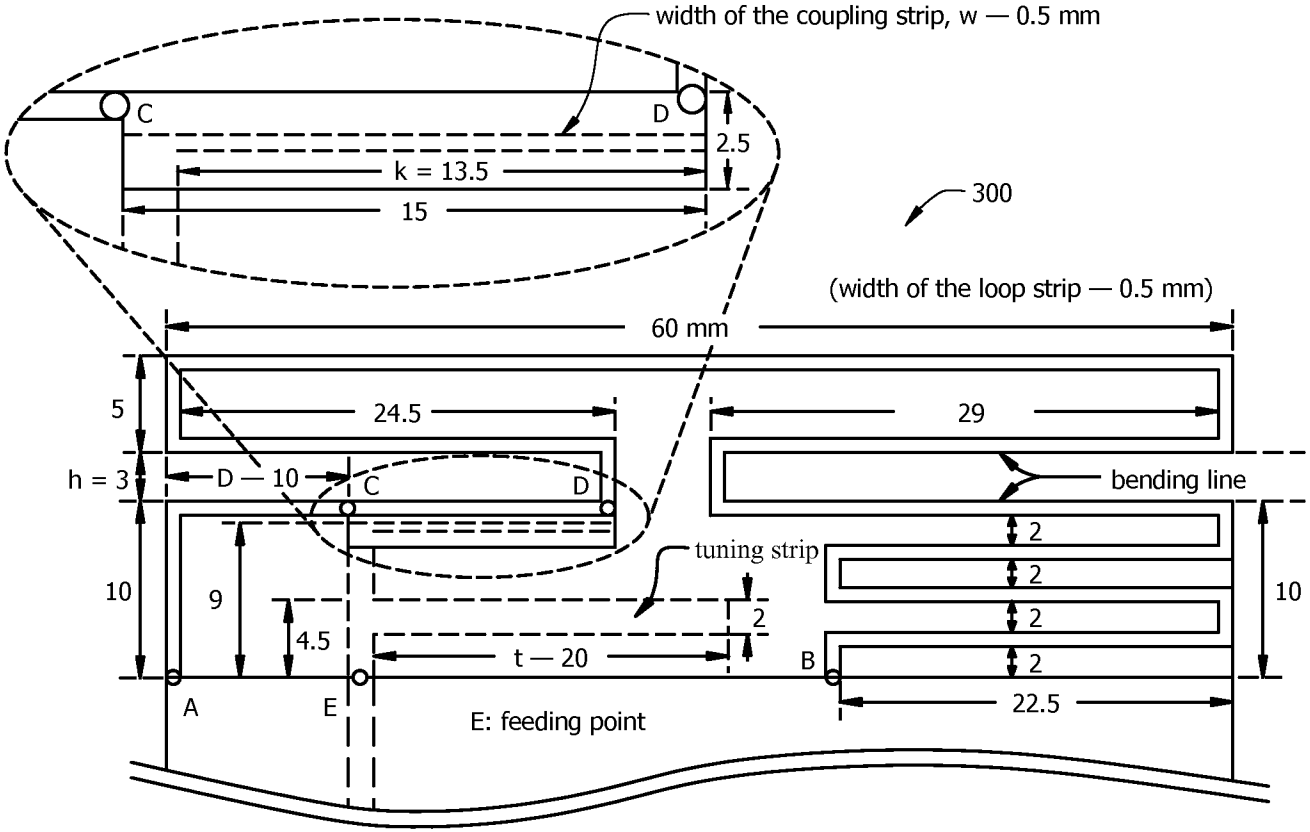
FIG. 3 is a schematic diagram of an embodiment of a seven-band surface mount loop antenna with a capacitively coupled feed for mobile phone applications.
Figure 4:
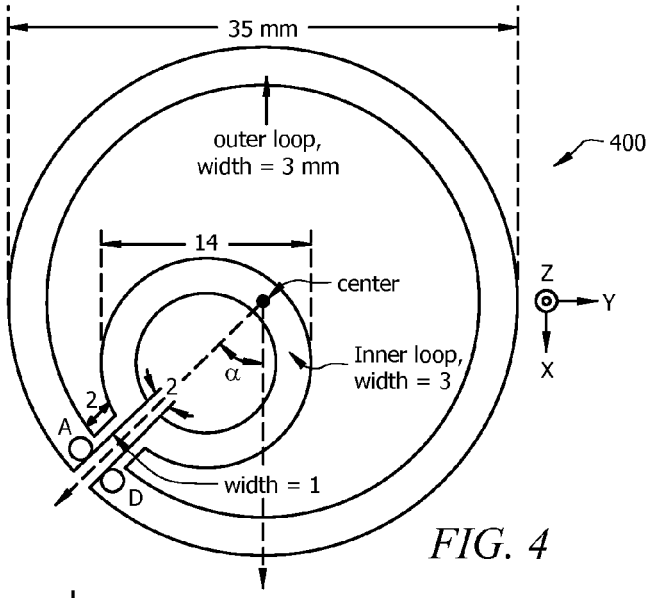
FIG. 4 is a schematic diagram of an embodiment and detail of a dual-polarized dual-loop antenna system for 2.4/5 GHz WLAN access points.

FIG. 3 is a seven-band surface-mount loop antenna with a capacitively coupled feed for mobile phone applications. FIG. 3 shows a single capacitively coupled loop antenna 300. FIG. 4 is a printed, dual-polarized dual-loop antenna for 2.4 GHz and 5 GHz WLAN access points. FIG. 4 shows a dual loop antenna 400 having a single feed, with one loop of the feed contained entirely within the other. The antennas depicted in FIGS. 3 and 4 and other designs may take different approaches to optimizing antenna efficiency. For example, the antenna 300 may simultaneously use a bottom and top antenna to connect both antennas to one or another transceiver all the time. Other solutions enable a single antenna structure to behave like multiple antennas through the use of multiple feed points using different modal excitation of a single radiating element structure.

Figure 5A:
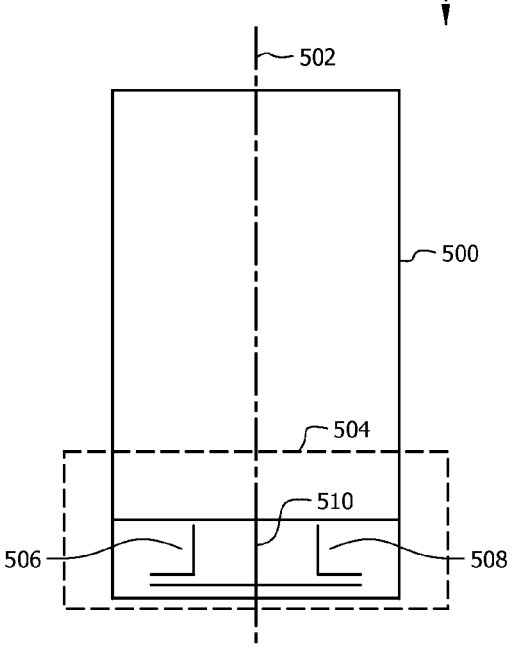
FIG. 5A is a schematic diagram of a rear view of a wireless communication device having an embodiment of a dual loop antenna system.

FIG. 5A is a schematic diagram of a rear view of a wireless communication device 500 having an embodiment of a dual loop antenna system. Wireless communication device 500 has a centerline 502 and is shown with antenna subsystem 504, which is shown in a detail view in FIG. 5B. Antenna subsystem 504 may comprise feed A 506, feed B 508, and T-shaped ground leg 510. Feed A 506 and the T-shaped ground leg 510 may comprise a first loop and feed B 508 and the T-shaped ground leg 510 may comprise a second loop, which may result in a dual loop antenna system as depicted by the circular arrows in FIG. 5. The components of FIG. 5 may be substantially similar to the components of FIG. 2, wherein wireless communication device 500 corresponds to wireless communication device 200, antenna subsystem 504 corresponds to antenna subsystem 220, feed 506 corresponds to antenna 212, and feed 508 corresponds to antenna 214. Feed 506 may be a separate antenna with a generally symmetric construction with respect to feed 508. In some embodiments, antenna subsystem 504 may occupy the same volume in wireless communication device 500 as conventional antenna subsystems.

Figure 5B:
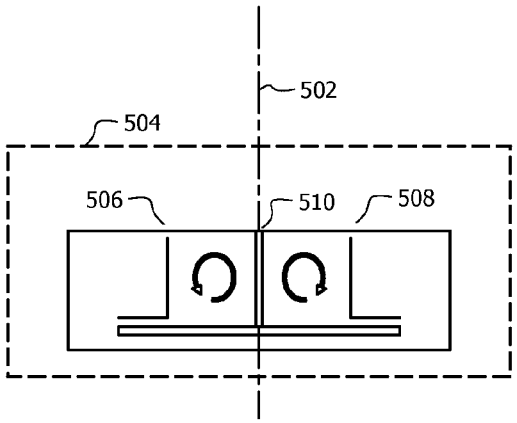
FIG. 5B is a schematic diagram of a detail view of the antenna subsystem of FIG. 5A.
Figure 6:
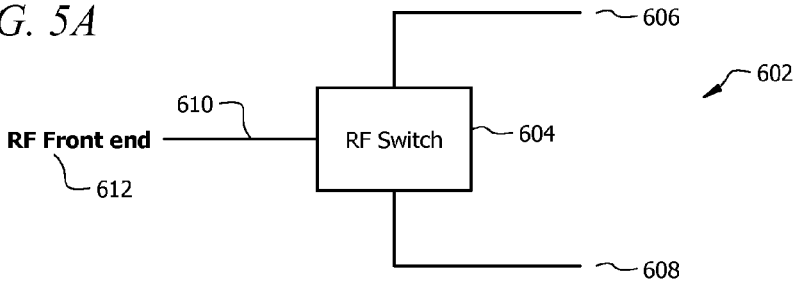
FIG. 6 is a schematic diagram of an embodiment of a dual loop antenna system and switch for selecting between two antennas.

FIG. 6 depicts a schematic diagram of an antenna subsystem 602 having a grounded RF switch 604, also referred to herein as a selection switch, common to feed 606 and feed 608. The antenna subsystem 602 may be substantially similar to the antenna subsystem 504 of FIG. 5, with feed 606 corresponding to feed 506 and feed 608 corresponding to feed 508. Positioned between feeds 606 and 608, the antenna subsystem 602 contains an RF switch 604 comprising the trace 610, e.g., an electrical or RF trace, also referred to herein as an RF line. The trace 610 may run to the RF front end 612, which may correspond to transceiver subsystem 220 of FIG. 2. RF switch 604 may select between using either feed 606 or feed 608 based on input from the RF front end 612.

Figure 7A:
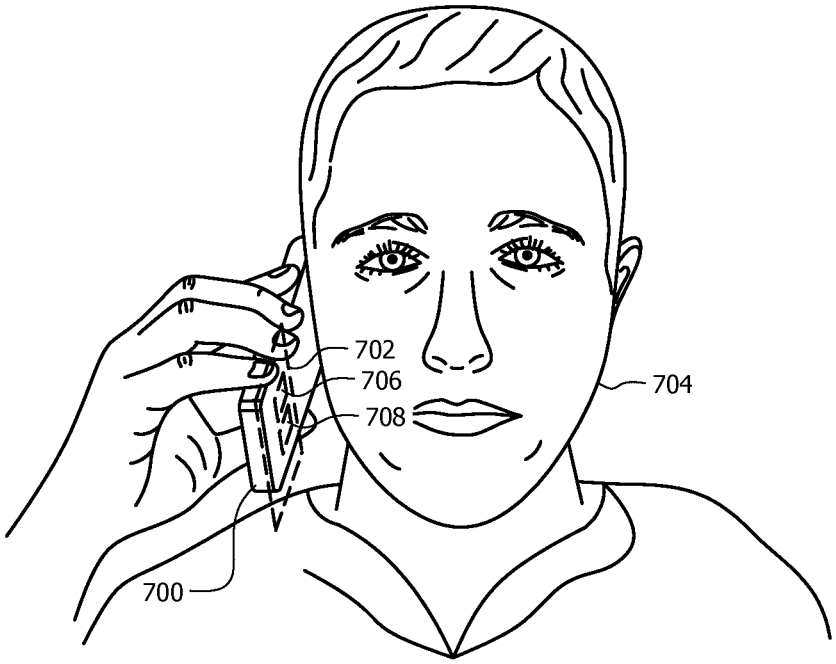
FIG. 7A is a schematic diagram of a right-side in-use wireless communication device.
Figure 7B:
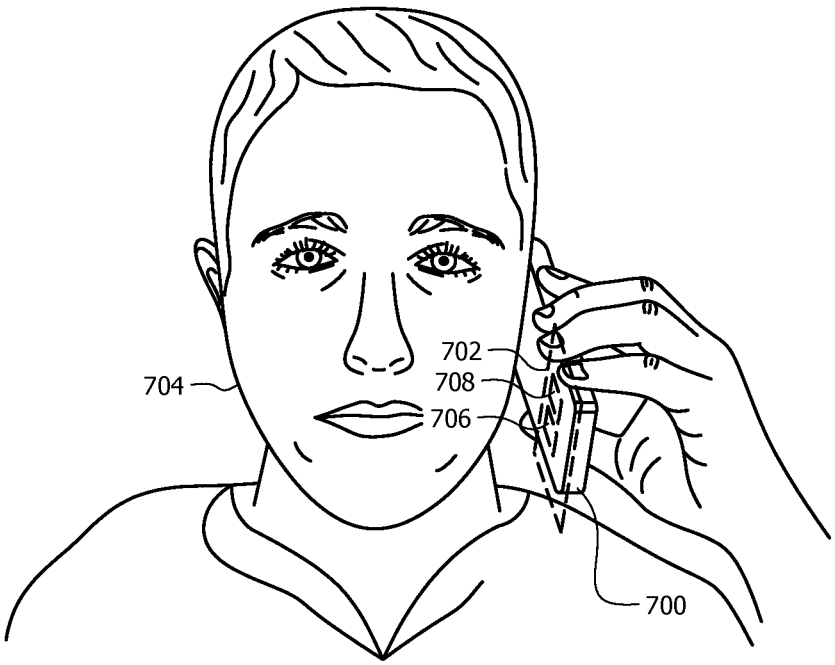
FIG. 7B is a schematic diagram of a left-side in-use wireless communication device.

FIG. 7A is a schematic diagram of a wireless communication device 700 having a dual loop antenna subsystem 702 proximate to the right side of a head 704. FIG. 7B is a schematic diagram of a wireless communication device 700 having a dual loop antenna subsystem 702 proximate to the right side of a head 704 proximate to the left side of a head 704. The dual loop antenna subsystem 702 comprises feeds 706 and 708. The components of FIGS. 7A and 7B may be substantially similar to the components of FIG. 5, wherein the wireless communication device 700 corresponds to the wireless communication device 500, the dual loop antenna subsystem 702 corresponds to the antenna subsystem 504, and feeds 706 and 708 correspond to feeds 506 and 508. For ease of reference and without limitation, positions depicted in FIGS. 7A and 7B, including a range of positions wherein the wireless communication device 700 is proximate to a user's head and has a centerline generally running from about the user's ear to about the user's mouth when the user's head is in a generally vertical position, may be referred to herein as the natural use position. In FIG. 7A, feed 706 is located in a relatively higher, less obstructed location, e.g., away from the palm of the user's left hand, while feed 708 is located in a relatively lower, more obstructed location, e.g., closer to the palm of the user's left hand. In FIG. 7B, feed 708 is located in a relatively higher, less obstructed location, e.g., away from the palm of the user's right hand, while feed 706 is located in a relatively lower, more obstructed location, e.g., closer to the palm of the user's right hand.

Figure 8:
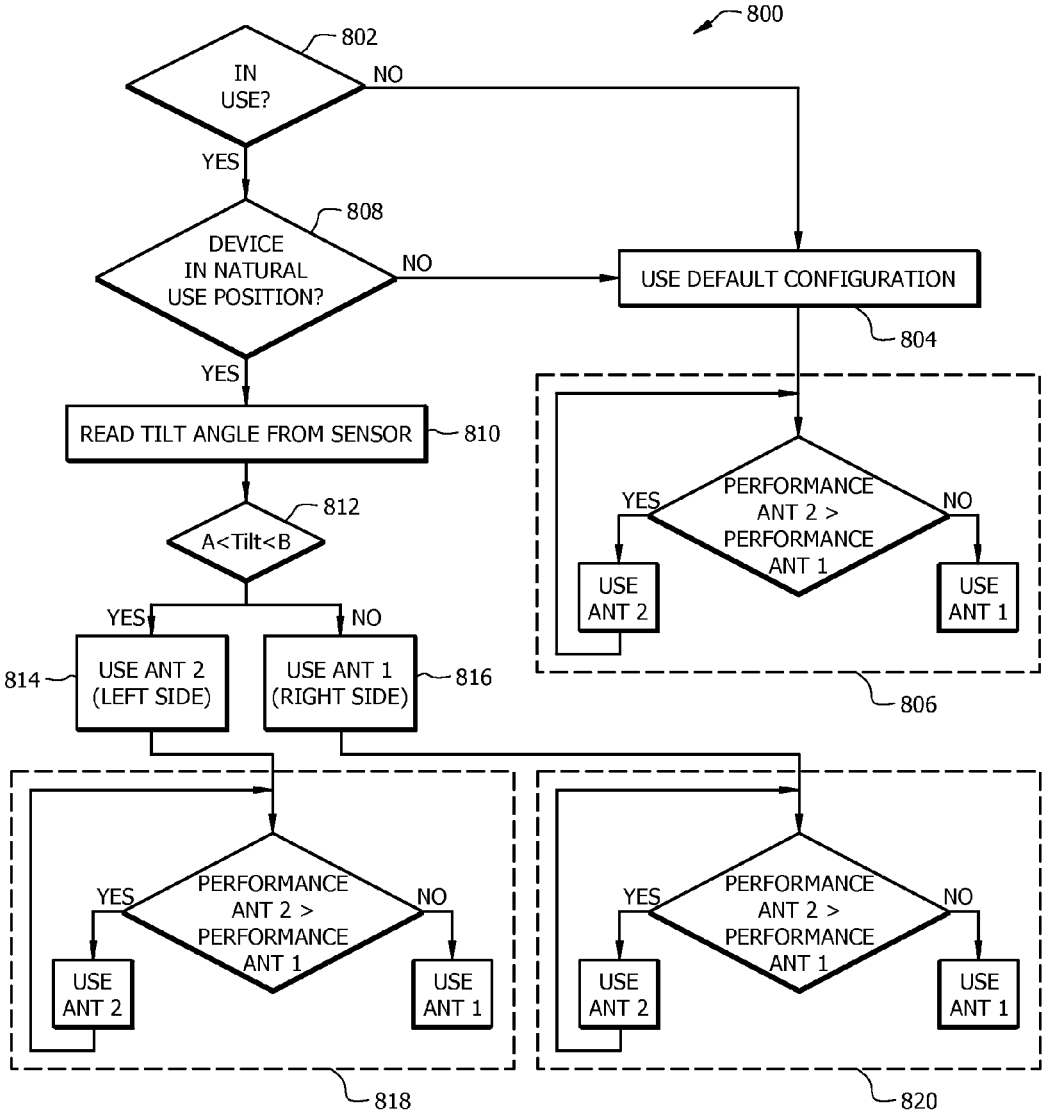
FIG. 8 depicts a flowchart of an embodiment of a method for a dual loop antenna system.

FIG. 8 depicts a flowchart of an embodiment of a method for a dual loop antenna system. Broadly, FIG. 8 depicts a process 800 wherein a wireless communication device, e.g., wireless communication device 700 of FIG. 7, determines whether the wireless communication device is in use. If so, the natural use position may be determined and an optimized use configuration is utilized. If not, a default standby configuration may be entered. Both the use and standby configurations may include feedback loops to readjust the respective configuration based on historic and/or real-time performance data. Process 800 begins at 802 with a wireless communication device determining whether the wireless communication device is in use, e.g., on a telephone call. If the wireless communication device is not in use, an antenna default configuration may be entered at 804. The default configuration may use a first antenna, e.g., feed 706 of FIGS. 7A and 7B, by default if no performance data is available. At 806, the wireless communication device may review the relevant performance data, e.g., RSSI/received signal quality, and select between using a first or second antenna, e.g., feed 706 or feed 708 of FIGS. 7A and 7B, based on the performance.

Returning to 802, if the wireless communication device is in use, the method 800 may proceed to 808. At 808, the wireless communication device may determine whether the wireless communication device is in a natural use position, e.g., by verifying that the proximity sensor is on, and that the speakerphone, headset and handsfree devices are off. If the wireless communication device is in a natural use position, the antenna default configuration may be entered at 804. If the wireless communication device is in a natural use position, the tilt angle may be read from a sensor, e.g., sensor 230 of FIG. 2, at 810. Based on the measured tilt angle, at 812 the wireless communication device may determine whether the wireless communication device is in a right-side or left-side natural use position. If the wireless communication device is in a right-side natural use position, the first antenna, e.g., feed 706 of FIGS. 7A and 7B, may be selected for use at 814. If the wireless communication device is in a left-side natural use position, the second antenna, e.g., feed 708 of FIGS. 7A and 7B, may be selected for use at 816. As with the default configuration, following selection of the first or second antenna at 814 or 816, a feedback protocol may be employed at 818 and 820 for 814 and 816, respectively, to ensure continued optimized performance.

Figure 9A:
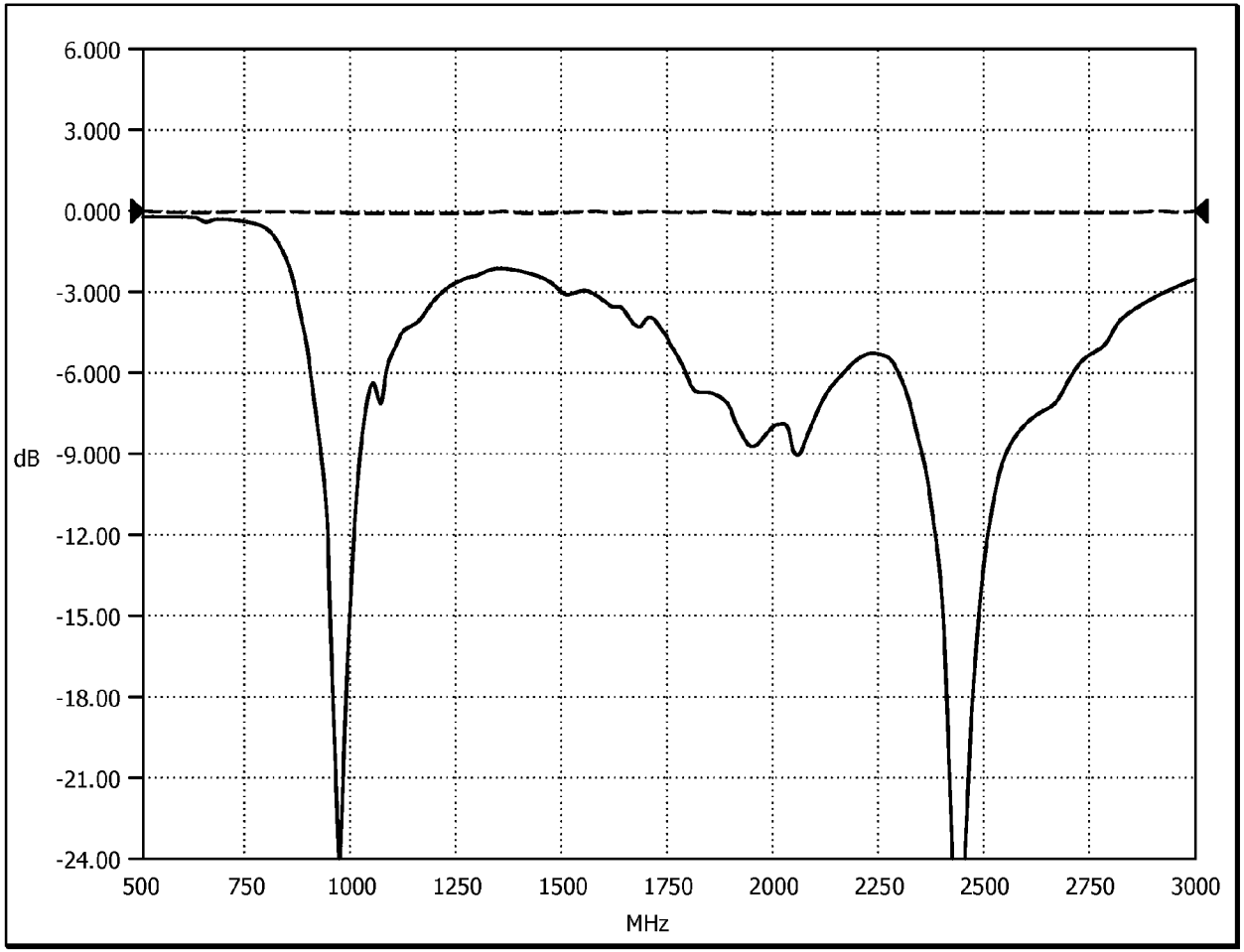
FIG. 9A is a return loss plot depicting free space performance of a first antenna over a range of frequencies.
Figure 9B:
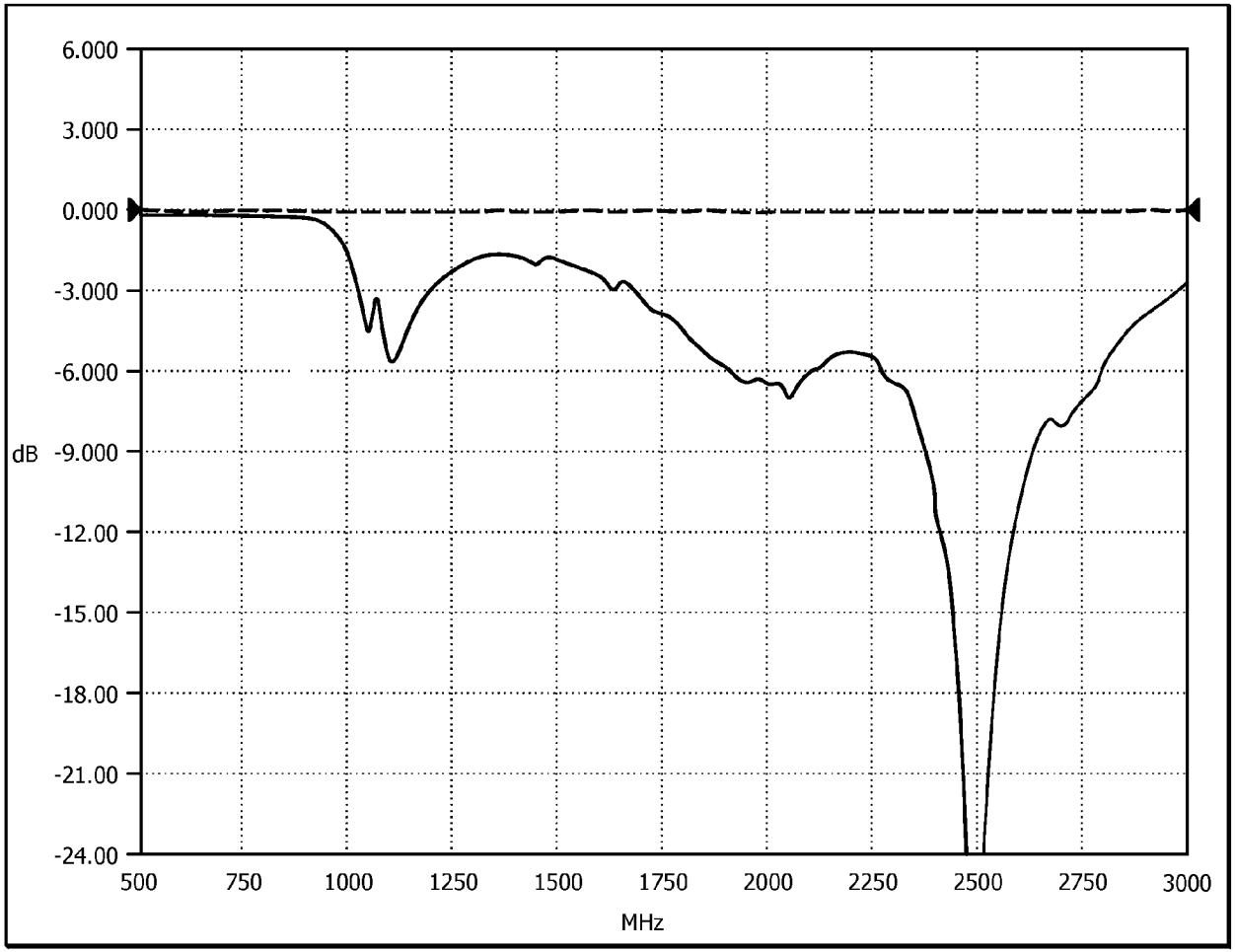
FIG. 9B is a return loss plot depicting free space performance of a second antenna over a range of frequencies.

FIG. 9A is a return loss plot depicting free space return loss of a first antenna, e.g., the first antenna of FIGS. 5A and 5B, over a range of frequencies. The first antenna of FIG. 9A is configured to transmit and receive (or operate) on a low band, e.g., about 900 MHz, and a high band, e.g., about 1800 MHz. FIG. 9B is a return loss plot depicting free space return loss of a second antenna, e.g., the second antenna of FIGS. 5A and 5B, over a range of frequencies. The second antenna of FIG. 9B is configured to operate on a high band, e.g., about 1800 MHz. The high bands of the first and second antennas of FIGS. 9A and 9B overlap. The y-axes of FIGS. 9A and 9B show return loss in decibels (dB). The x-axes of FIGS. 9A and 9B show frequency in MHz.

Figure 9C:
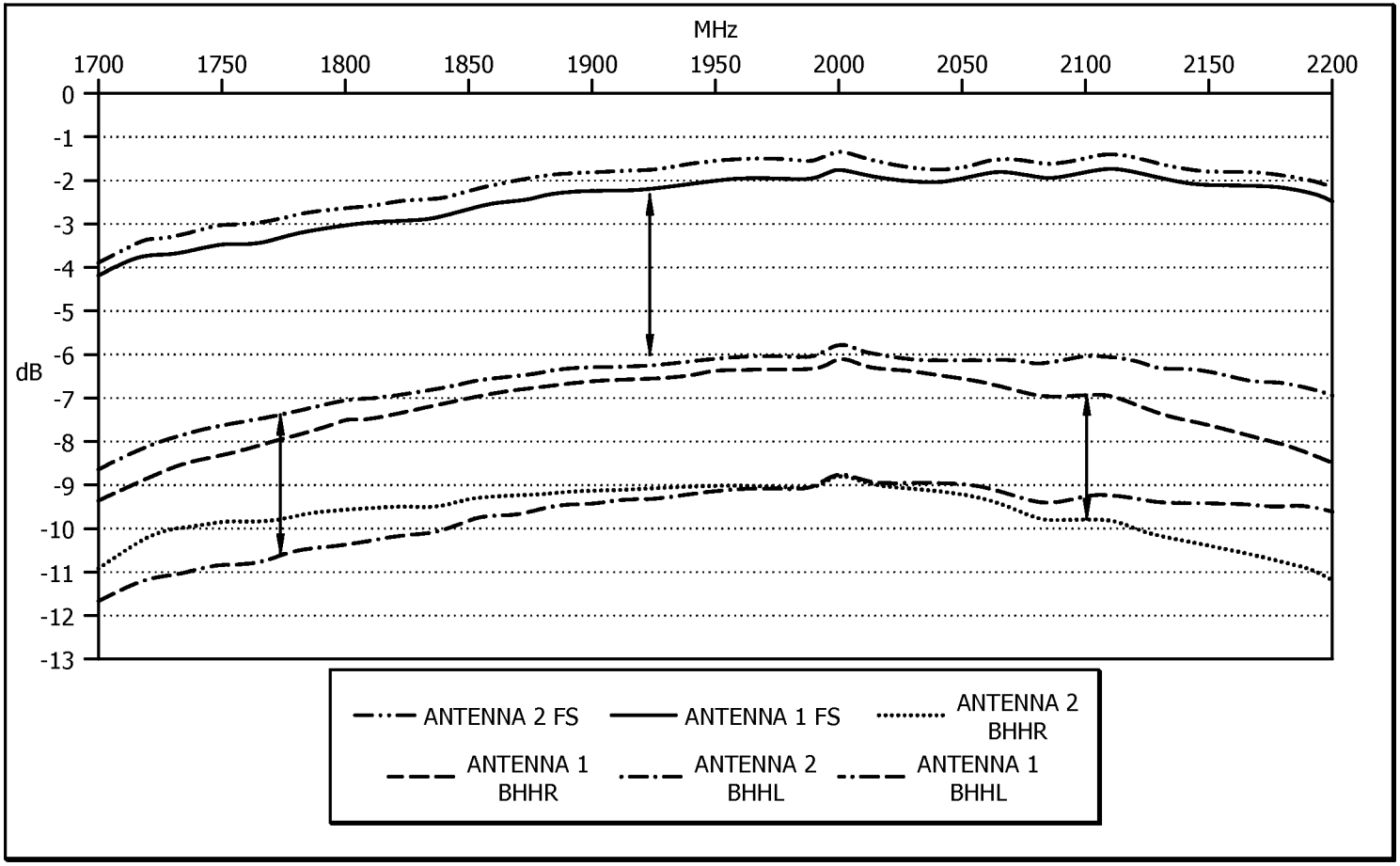
FIG. 9C is a plot depicting the antenna efficiency of a first and second antenna in free space, in obstructed real-world, and in non-obstructed real-world environments.

FIG. 9C is a plot depicting the high band antenna efficiency of the first and second antennas of FIGS. 9A and 9B in free space, in obstructed real-world, and in non-obstructed real-world environments. The y-axis of FIG. 9C shows antenna efficiency in dB. The x-axis of FIG. 9 shows frequency in MHz. Three measurements are depicted for each antenna: (1) free space (FS), (2) beside head and hand, right side (BHHR), and (3) beside head and hand, left side (BHHL). The BHHR and BHHL positions may correspond to the wireless communication device orientations depicted in FIGS. 7A and 7B, respectively, with the first antenna corresponding to antenna 708 and the second antenna corresponding to antenna 706. In the BHHR position, the first antenna is relatively more obstructed by the user's head and/or hand and the second antenna is relatively less obstructed. In the BHHL position, the second antenna is relatively more obstructed by the user's head and/or hand and the first antenna is relatively less obstructed. FIG. 9C shows the efficiency for both antennas increasing by a noticeable amount, e.g., reducing losses by about half from the obstructed position to the FS position and/or about 3 dB, when shifted from an obstructed to a non-obstructed position. Consequently, by selectively utilizing the non-obstructed antenna for communication, a dual feed antenna system may provide greater overall antenna efficiency.

Figure 10A:
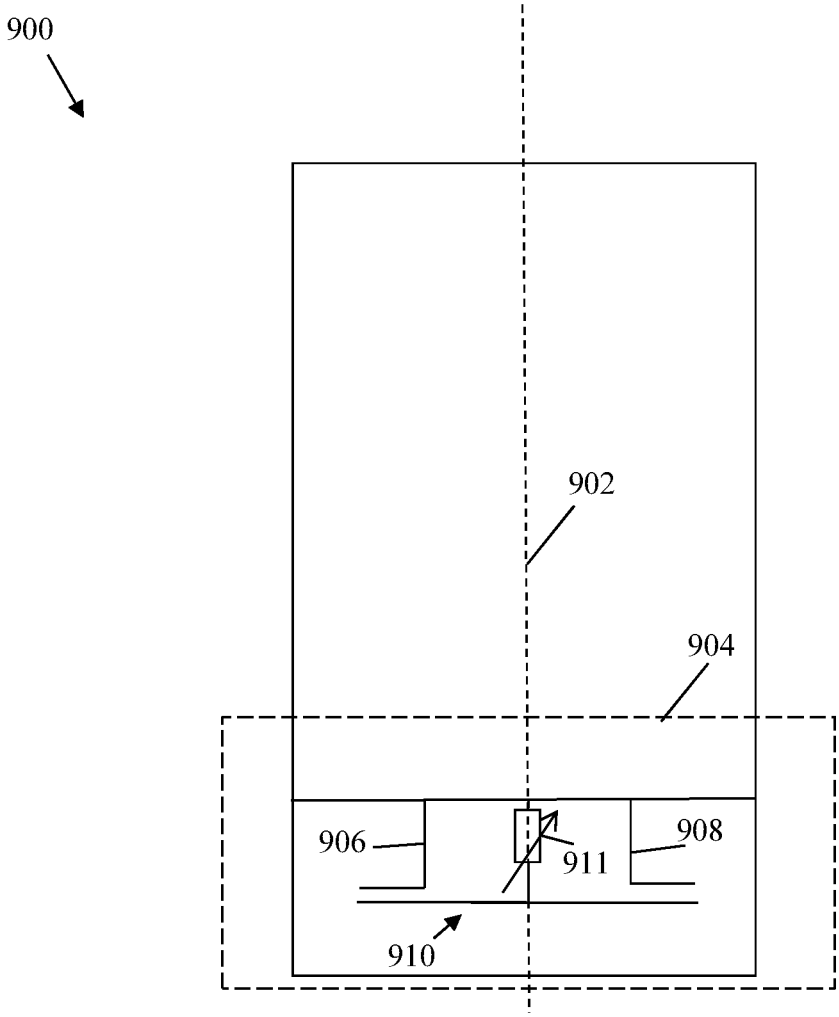
FIG. 10A is a schematic diagram of a rear view of a wireless communication device having another embodiment of a dual loop antenna system.
Figure 10B:
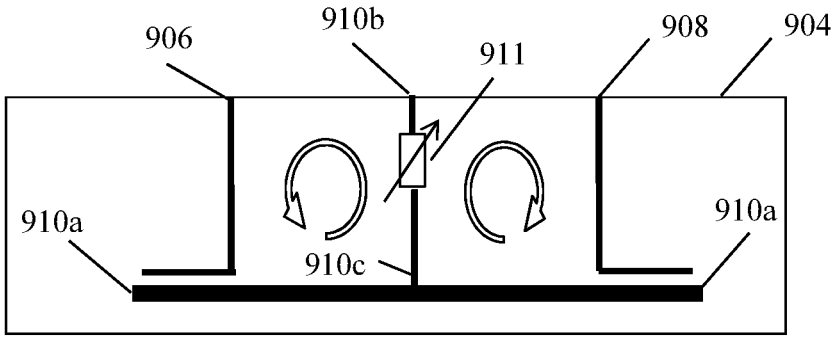
FIG. 10B is a schematic diagram of a detail view of the antenna subsystem of FIG. 10A.

FIG. 10A is a schematic diagram of a rear view of a wireless communication device 900 having another embodiment of a dual loop antenna system 904. Wireless communication device 900 has a centerline 902 and is shown with dual loop antenna system 904, which is shown in a detail view in FIG. 10B. Antenna subsystem 904 may comprise feed A 906 (sometimes referred to herein as a feed conductor), feed B 908 (sometimes referred to herein as a feed conductor), and T-shaped ground leg 910, which may be similar to feed A 506, feed B 508, and T-shaped ground leg 510, respectively. The dual loop antenna system 904 may comprise two loops, as depicted by the arrows in FIGS. 10A and 10B and two distinct feed points (e.g. feed A 906 and feed B 908, respectively. The T-shaped ground leg 910 may comprise one or more antenna portions 910*a*, which may act as a transmitter and receiver and may be coupled to feed A 906 and/or feed B 908 via a capacitive electromagnetic field as shown in FIGS. 10A and 10B. The antenna portions 910*a* may form a single conductor (a conducting strip). The T-shaped ground leg 910 may also comprise a ground connection 910*b* and a common section 910*c*. The antenna portions 910*a* may be coupled to the ground connection 910*b* via the common section 910*c* and a variable impedance load 911 (sometimes referred to herein as a "variable load"). Thus, the variable impedance load 911 may be connected between the conductor 910*a* and the ground connection 910*b*. The variable impedance load 911 may be discrete and/or analog. A discrete impedance load 911 may comprise a plurality of discrete impedance values. An analog impedance load 911 may comprise a nondiscrete continuum of impedance values. For example, a variable impedance load 911 may comprise a tunable capacitor such as a Microelectromechanical systems (MEMS) capacitor, a Barium Strontium Titanate (BST) capacitor, a varactor diode, etc. The variable impedance load 911 may be altered during operation to change the transmission characteristics of the antenna system 904. For example, the variable impedance load 911 may be altered to tune the antenna system 904 for optimized resonance at specific bandwidth ranges, such as about 698 MHz to about 746 MHz, about 824 MHz to about 960 MHz, and/or other low band transmission ranges. Tuning the antenna system 904 during operation may increase the effective bandwidth range over which the antenna system 904 may operate. A first antenna may comprise feed 906 and T-shaped ground leg 910, and a second antenna may comprise feed 908 and T-shaped ground leg 910. The antenna portions 910*a*, variable load 911, and ground connection 910*b* may be conductors common to both the first and second antennas.

Figure 11:
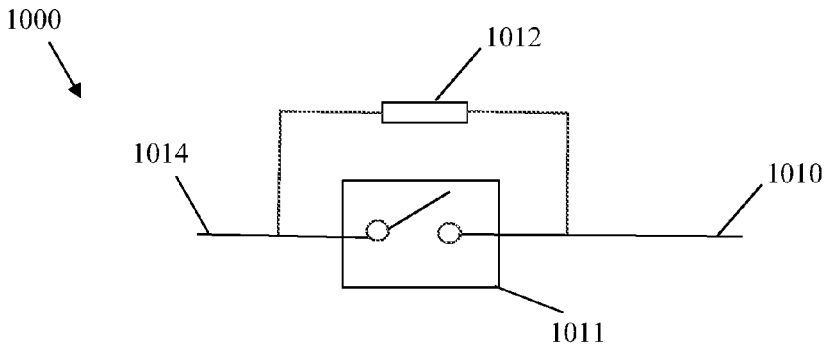
FIG. 11 is a schematic diagram of a detail view of an embodiment of a variable impedance load.

FIG. 11 is a schematic diagram of a detail view of an embodiment of a variable impedance load 1000, which may be an implementation of variable impedance load 911. Variable impedance load 1000 may be implemented via a single pole, single throw (SPST) RF switch 1011 positioned between ground connection 1010 and a common connection 1014 (e.g. ground connection 910*b* and common section 910*c*, respectively.) The ground connection 1010 and a common connection 1014 may be coupled by the switch 1011 and an impedance load 1012. When the switch 1011 is in a closed position, the switch 1011 coupling may create an electrical short which may result in an impedance of about zero nanohenries (nH). When the switch 1011 is in an open position, as shown in FIG. 11, the path between the ground connection 1010 and the common connection 1014 may pass through the impedance load 1012, which may result in impedance equal to about the impedance imparted to the circuit by impedance load 1012. For example, if impedance load 1012 imparts an impedance of about 7.5 nH, the variable impedance load 1000 may impart an impedance of about zero nH when the switch 1011 is closed and an impedance of about 7.5 nH when the switch 1011 is open. As such, variable impedance load 1000 may comprise a discrete variable impedance load (e.g. either about 7.5 nH or about zero nH) and may be positioned between the common connection 1014 and the ground connection 1010 and employed to change the common impedance load of the antenna loops (e.g. loops comprising feed A 906, feed B 908, and T-shaped ground leg 910.) As such, switch 1011 may be operated to control the impedance of the antenna(s) to which variable impedance load 1000 is connected to tune the antenna(s) to a desired frequency band resonance, which may allow the antenna(s) to achieve a larger overall frequency transmission bandwidth.

Figure 12:
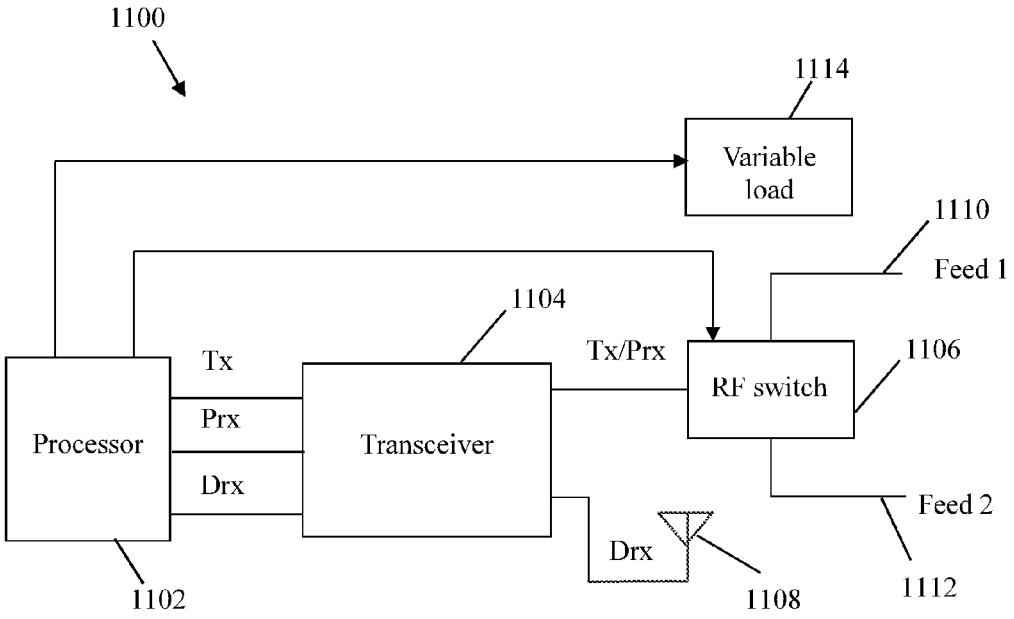
FIG. 12 is a schematic diagram of another embodiment of a dual loop antenna system.

FIG. 12 is a schematic diagram of another embodiment of a dual loop antenna system 1100. Antenna system 1100 may comprise a processor 1102, a transceiver 1104, and an RF switch 1106, which may be substantially similar to processor 250, transceiver subsystem 220, and RF switch 604, respectively, and may be connected as shown in FIG. 12. The antenna system 1100 may further comprise a variable load 1114. The processor 1102 may be configured to receive a Primary data receive (Prx) signal and a Diversity receive (Drx) signal via the transceiver 1104. The processor 1102 may be further configured to transmit a transmission (Tx) signal via the transceiver 1104. Antenna system 1100 may be positioned in a wireless communication device (e.g. wireless communication device 900.) The Tx signal and the Prx signal may be signals sent and received, respectively, by the wireless communication device when the wireless communication device is in active communication with a correspondent node (e.g. a wireless tower.) The Drx signal may be a secondary communication signal used to supplement the Prx to improve the quality and/or reliability of the communication (e.g. to account for signal interference, etc.) The Drx signal may be received from a dedicated Drx antenna 1108 via the transceiver 1104. The Tx and Prx may be transmitted and received via feed 1110 and/or feed 1112, which may be substantially similar to feed 906 and feed 908, respectively. Feed 1110 and Feed 1112 may be coupled to the transceiver 1104 via the RF switch 1106. The RF switch 1106 may comprise a downstream port and may be operated to alternate the Tx/Prx feed between feed 1110 and feed 1112. As such, the RF switch 1106 may control whether feed 1110 and/or feed 1112 is actively receiving/transmitting the Tx/Prx signals at a specified time, which may allow for controlled variation of transmission and/or reception characteristics of the attached antenna(s). This may be beneficial when communicating across particular frequency bands and may allow for increased overall bandwidth. For example, switching the active Tx/Prx feed via the RF switch 1106 may change the location of the feed with respect to the transmitting and/or receiving portion of the antenna, such as antenna portions 910*a*.

The variable load 1114 may be part of a ground line that is capacitively coupled to feed 1 1110 and feed 2 1112. For example, the ground line may be configured the same as 910*a*-910*c* and 911, with the variable load placed in the position of variable load 911. Further, the variable load 1114 may be any load with a variable impedance that may be controlled via a control signal, such as the variable load 1000. The impedance of the variable load 1114 may be controlled by the processor 1102. Alternatively, the impedance of the variable load 1114 may be controlled by the transceiver 1104.

Figure 13:
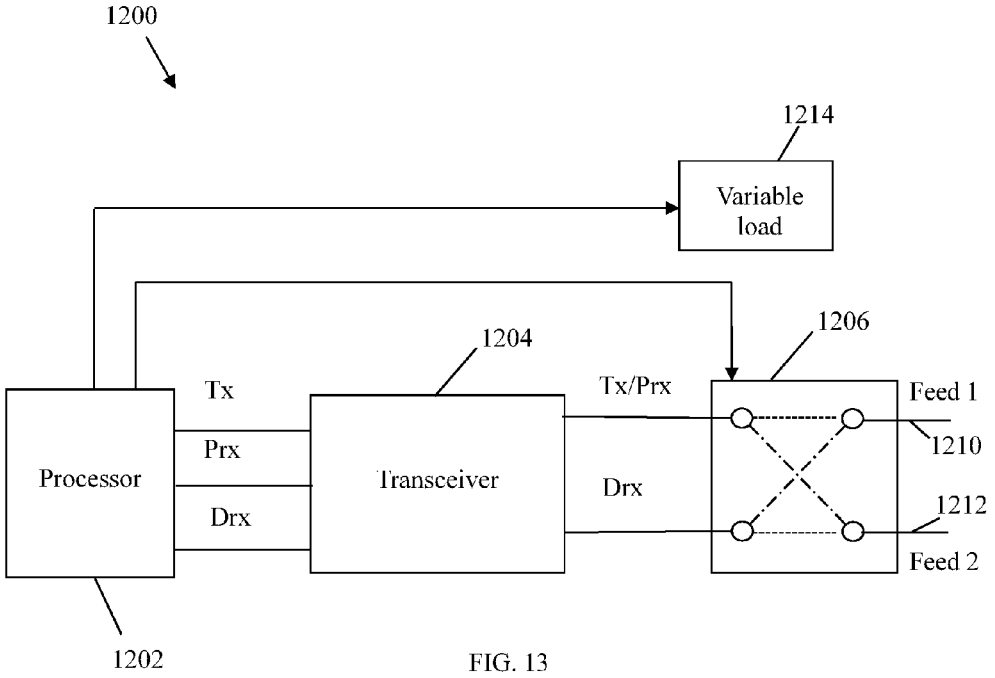
FIG. 13 is a schematic diagram of another embodiment of a dual loop antenna system.

FIG. 13 is a schematic diagram of another embodiment of a dual loop antenna system 1200. System 1200 may comprise a processor 1202 and a transceiver 1204, which may be substantially similar to processor 1102 and a transceiver 1104, respectively. The system 1200 may further comprise a switch 1206, which may be similar to RF switch 1106, but may comprise two downstream ports and may accept two signal groupings, for example Tx/Prx and Drx. The antenna system 1200 may further comprise a variable load 1214. As shown in FIG. 13, processor 1202 may receive and/or transmit Tx, PRx, and/or Drx via transceiver 1204. Transceiver 1204 may receive Drx from one downstream port of switch 1206 and transmit/receive Tx/Prx via a second downstream port of switch 1206. Switch 1206 may comprise two upstream ports, which may be connected to feed 1210 and feed 1212. Feeds 1210 and feed 1212 may be substantially similar to feeds 906 and 908, respectively. Switch 1206 may couple Tx/Prx to feed 1210 and Drx to feed 1212 when at a first position and couple Tx/Prx to feed 1212 and Drx to feed 1210 when at a second position. The switching of switch 1206 may change the location of the Tx, Prx, and/or Drx signals and the with respect to the transmitting and/or receiving portion of the antenna, such as antenna portions 910*a*. Such switching may allow for controlled variation of transmission and/or reception characteristics of the attached antennas, which may increase the effective bandwidth of the antennas and increase the overall antenna system performance. The dual loop antenna system 1200 allows the transmit path to be either routed to a first antenna or to a second antenna, while both antennas may be used for reception.

The variable load 1214 may be part of a ground line that is capacitively coupled to feed 1 1210 and feed 2 1212. For example, the ground line may be configured the same as 910*a*-910*c* and 911, with the variable load placed in the position of variable load 911. Further, the variable load 1214 may be any load with a variable impedance that may be controlled via a control signal, such as the variable load 1000. The impedance of the variable load 1214 may be controlled by the processor 1202. Alternatively, the impedance of the variable load 1214 may be controlled by the transceiver 1204.

Figure 14A:
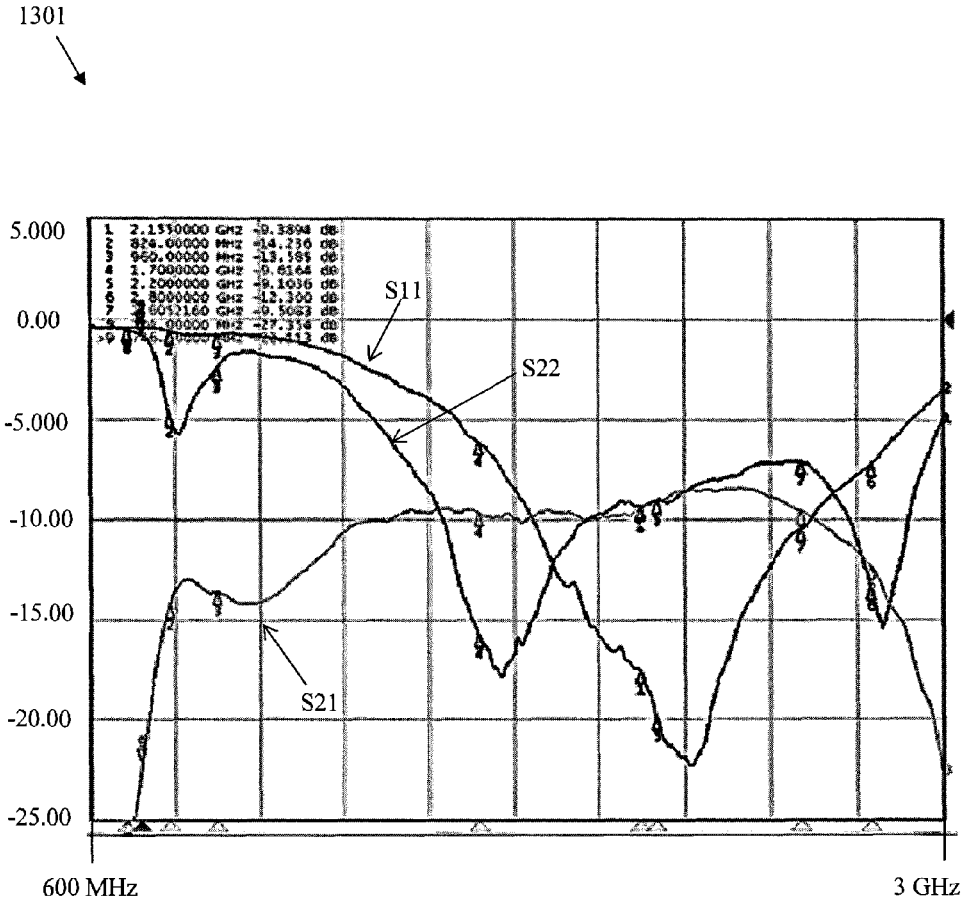
FIG. 14A is a plot depicting free space performance of an antenna over a range of frequencies when a switch is in a closed position.

FIG. 14A is a plot 1301 depicting free space performance of an antenna, such as dual loop antenna system 904 when one of the two loops is active and the other one of the two loops is inactive, over a range of frequencies when a switch, such as switch 1011, is in a closed position which may result in an impedance of about zero between an common section and a ground connection of a T-shaped ground leg (e.g. a common section 910*c*, ground connection 910*b*, and T-shaped ground leg 910, respectively.) The y-axis is in units of dB, and the x-axis represents frequency and spans from 600 mHz to 3 GHz in a linear scale. Plot 1301 may depict an S11 and an S22 for feed 1 and feed 2 (e.g. feed 906 and 908, respectively). S11 and S22 may be the ratio of the amount of voltage input into the feed versus the amount of voltage reflected back into a ground connection. For example, S11 may be the ratio of voltage applied to feed 906 versus the voltage reflected back to feed 906, and S22 may be the ratio of voltage applied to feed 908 versus the voltage reflected back to feed 908, respectively. Plot 1301 may also depict the isolation between both feeds, S21. As shown, S22 may be below −5 dB between about 824 MHz and about 960 MHz, which may indicate that the antenna associated with S22 is tuned for transmission and/or reception across the 824 MHz to 960 MHz frequency band.

Figure 14B:
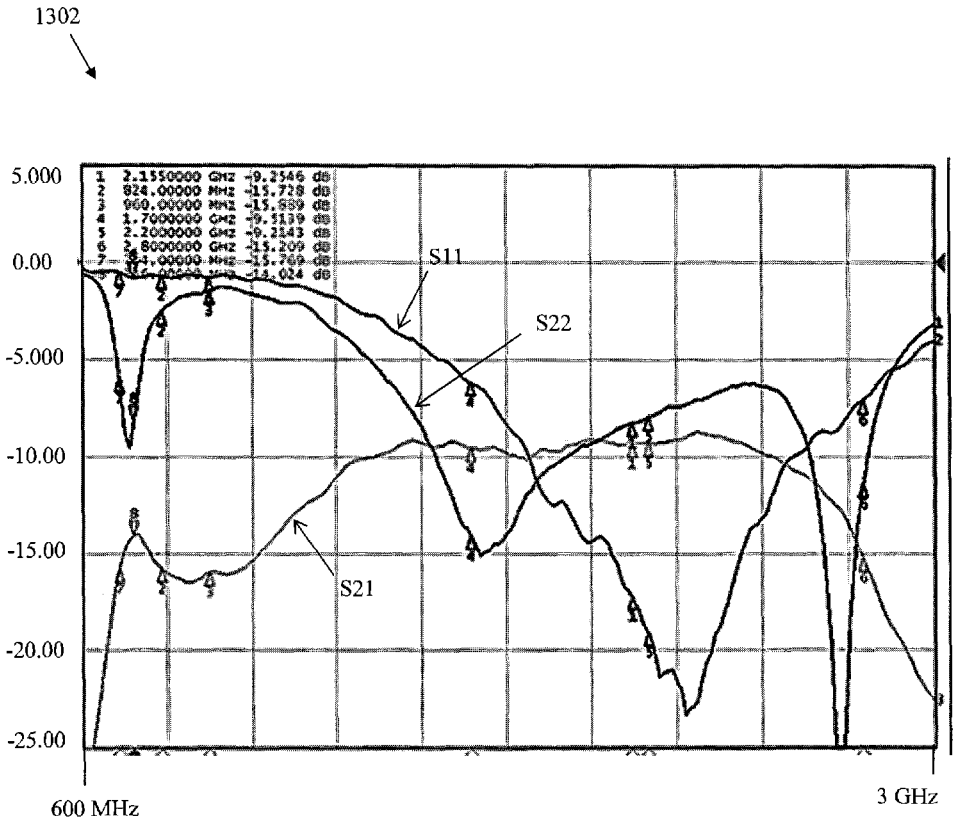
FIG. 14B is a plot depicting free space performance of an antenna over a range of frequencies when a switch is in an open position.

FIG. 14B is a plot depicting free space performance of an antenna, such as dual loop antenna system 904 when one of the two loops is active and the other one of the two loops is inactive, over a range of frequencies when a switch, such as switch 1011, is in an open position which may result in an impedance of about 7.5 nH between an common section and a ground connection of a T-shaped ground leg (e.g. a common section 910*c*, ground connection 910*b*, and T-shaped ground leg 910, respectively.) The y-axis is in units of dB, and the x-axis represents frequency and spans from 600 mHz to 3 GHz in a linear scale. Plot 1302 may depict an S11 and an S22 for feed 1 and feed 2 and S21 of both feeds. As shown, S22 may be below −5 dB between about 698 MHz and about 746 MHz, which may indicate that that the antenna associated with S22 is tuned for transmission and/or reception across the 698 MHz to 746 MHz frequency band, which may be known as band 12.

The results in FIGS. 14A and 14B imply that by switching a switch, such as switch 1011, between an open and closed position, a load impedance may be varied consequently adjusting or varying a frequency band (e.g., a low band) of an antenna while keeping the high band response substantially constant. This could be useful, for example, in cellular systems that comply with long term evolution (LTE) standards, and particularly in meeting the frequency banding requirements of LTE standards.

Further, notice that the low band response is significant only in one of the antennas, while the other one presents a weak response that almost cannot be seen in FIGS. 14A and 14B. This is due to the asymmetry of the antenna structure used to generate the results. One of the antennas has the feed arm closer to the common T-shaped ground structure presenting a higher coupling and thus having a better low band response than the other antenna which has the feed arm further away and presents lower coupling. Accordingly, for high band operation the performance would be similar for both antennas and selection can be done based on orientation. But for the low band operation, one of the antennas may present significantly better performance and may be selected regardless of orientation. Additionally, the low band of the selected antenna may be tuned based on the tunable load. Alternatively, if the loops are symmetric then the low band characteristics of both antennas would be similar.

Figure 15:
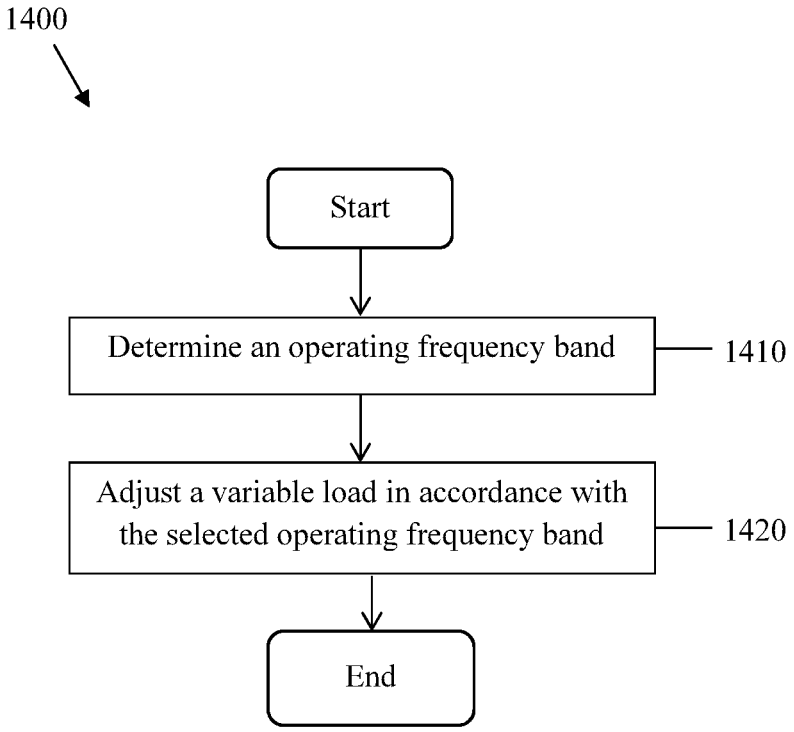
FIG. 15 is a flowchart of an embodiment of a method for setting an operating frequency band of a wireless communication device.

FIG. 15 is a flowchart of an embodiment of a method 1400 for setting an operating frequency band of a wireless communication device. The method 1400 begins in block 1410 in which an operating frequency band may be selected from a plurality of bands. For example, one of the bands may be about 698 MHz to 746 MHz and a second band may be about 824 MHz to 960 MHz, such as discussed with respect to FIGS. 14A and 14B. Next in block 1420, a variable load may be adjusted in accordance with the selected operating frequency band. For example, the variable load 1000 may be 0 nH or 7.5 nH depending on whether the switch 1011 is closed or open, respectively. The method 1400 may operate independently of or in conjunction with the method 800. The method 1400 may be implemented by the dual loop antenna systems 1100 and/or 1200. For example, the processors 1102 and/or 1202 may be configured to implement blocks 1410 and 1420. Block 1420 may be implemented by controlling variable loads 1114 and/or 1214.

Figure 16:
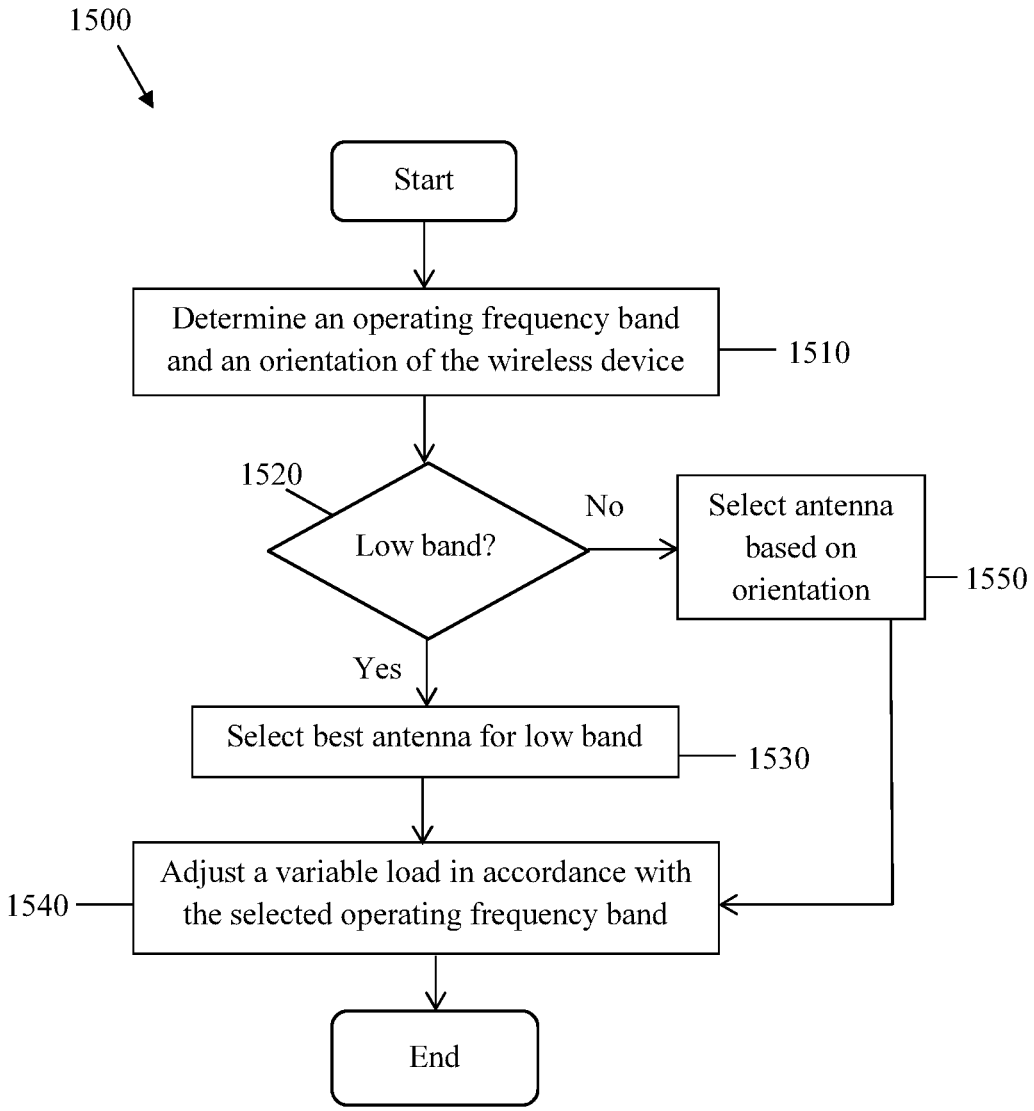
FIG. 16 is a flowchart of an embodiment of a method for configuring a wireless communication device.

FIG. 16 is a flowchart of an embodiment of a method 1500 for configuring a wireless communication device. The method 1500 begins in block 1510 in which an operating frequency band may be selected from a plurality of bands. For example, one of the bands may be about 698 MHz to 746 MHz and a second band may be about 824 MHz to 960 MHz, such as discussed with respect to FIGS. 14A and 14B. Also, in block 1510 an orientation of the wireless device may be determined. Next in block 1520 a determination may be made whether the band is a low band. If the band is a low band, block 1530 is performed next. In block 1530 the best antenna for low bands may be selected. Note that one antenna may be clearly better than another antenna for all low bands. Next in block 1540 a variable load may be adjusted in accordance with the selected operating low band. For example, the variable load 1000 may be 0 nH or 7.5 nH depending on whether the switch 1011 is closed or open, respectively. The variable load may tune the selected antenna for the particular low band selected. If, however, the determined band is a high band in block 1520, an antenna may be selected based on orientation of the wireless communication device comprising the two antennas in block 1550. For example, the method 800 may be performed in block 1550. After block 1550, block 1540 may be performed to fine tune the selected antenna.

The method 1500 may be implemented by the dual loop antenna systems 1100 and/or 1200. For example, the processors 1102 and/or 1202 may be configured to implement blocks 1510-1530. Block 1540 may be implemented by controlling variable loads 1114 and/or 1214. As a person of ordinary skill in the art will recognize, the method 1500 is one embodiment for configuring a wireless communication device based on a combination of the operating frequency band and the orientation of the device.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. The use of the term about means ±10% of the subsequent number, unless otherwise stated. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present disclosure. The discussion of a reference in the disclosure is not an admission that it is prior art, especially any reference that has a publication date after the priority date of this application. The disclosure of all patents, patent applications, and publications cited in the disclosure are hereby incorporated by reference, to the extent that they provide exemplary, procedural, or other details supplementary to the disclosure.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

What is claimed is:

1. An apparatus comprising:

a first antenna configured to be driven by a first feed;

a second antenna configured to be driven by a second feed different from and physically separated from the first feed, wherein the first antenna and the second antenna comprise a common conductor;

a variable load disposed between the first feed and the second feed and connected between the common conductor and a ground connection, wherein an impedance of the variable load is variable, and wherein an operating frequency of the first antenna and the second antenna depends on the impedance; and a selection switch coupled to the first antenna and the second antenna, wherein the selection switch is configured to activate the first antenna and deactivate the second antenna in a first state, wherein the selection switch is configured to activate the second antenna and deactivate the first antenna in a second state, and wherein the first antenna and the second antenna do not overlap each other.

2. The apparatus of claim 1, wherein the first antenna and the second antenna are loop antennas.

3. The apparatus of claim 1, further comprising a third antenna, wherein the third antenna is configured to be used for receiving a signal in conjunction with the first antenna when the first antenna is activated and in conjunction with the second antenna when the second antenna is activated.

4. The apparatus of claim 1, wherein the variable load comprises a load and a switch, wherein the load and the switch are connected in parallel.

5. The apparatus of claim 1, further comprising:

a processor coupled to the variable load, wherein the processor is configured to:

select a first operating frequency of the apparatus; and adjust the impedance of the variable load in accordance with the first operating frequency.

6. The apparatus of claim 5, wherein the processor is coupled to the selection switch, and wherein the processor is further configured to:

acquire a tilt of the apparatus relative to a vertical direction;

select a state from among the first state and the second state based on the tilt; and set the selection switch to the state.

7. The apparatus of claim 1, wherein the variable load is a tunable capacitor.

8. A wireless communication device comprising:

a first antenna configured to be driven by a first feed;

a second antenna configured to be driven by a second feed different from and physically separated from the first feed, wherein the first antenna and the second antenna comprise a common conductor but do not overlap each other;

a variable load disposed between the first feed and the second feed and connected between the common conductor and a ground connection, wherein an impedance of the variable load is variable, and wherein an operating frequency of the first antenna and the second antenna depends on the impedance;

a selection switch coupled to the first antenna and the second antenna, wherein the selection switch is configured to activate only the first antenna in a first state and activate only the second antenna in a second state; and a processor coupled to the variable load and the selection switch, wherein the processor is configured to:

set a state of the selection switch from among the first state and the second state based on an orientation of the wireless communication device;

select a first operating frequency band; and set the impedance to a value to achieve the first operating frequency band.

9. The wireless communication device of claim 8, wherein setting the state comprises:

acquiring a tilt of the wireless communication device relative to a vertical direction;

selecting the state of the selection switch from among the first state and the second state based on the tilt;

setting the selection switch to the selected state.

10. The wireless communication device of claim 9, further comprising a sensor to measure the tilt, wherein the processor is coupled to the sensor, and wherein the tilt is acquired from the sensor.

11. The wireless communication device of claim 8, wherein the processor is further configured to:

select a state of the selection switch from among the first state and the second state based on a physical orientation of the wireless communication device with respect to a user; and set the selection switch to the selected state.

12. The wireless communication device of claim 8, wherein the variable load comprises a load and a switch, wherein the load and the switch are connected in parallel, and wherein setting the impedance to the value comprises opening or closing the switch.

13. The wireless communication device of claim 8, wherein the first antenna and the second antenna are loop antennas.

14. The wireless communication device of claim 8, wherein the first feed and the second feed are capacitively coupled to different points of the common conductor, and wherein the selection switch is connected to the first feed and the second feed.

15. A method for operating a wireless communication device comprising a first antenna configured to be driven by a first feed, a second antenna configured to be driven by a second feed different from and physically separated from the first feed, and a variable load disposed between the first feed and the second feed, wherein the first antenna and the second antenna share a common conductor but do not overlap each other, and wherein the variable load is directly connected to the common conductor, the method comprising:

determining an orientation of the wireless communication device;

determining an operating frequency band;

activating only one of the first antenna or the second antenna based on at least one of the operating frequency band and the orientation; and adjusting an impedance of the variable load in accordance with the operating frequency band.

16. The method of claim 15, wherein the wireless communication device further comprises a selection switch coupled to the first antenna and the second antenna, wherein the selection switch is configured to activate only the first antenna in a first state and to activate only the second antenna in a second state, and wherein the activating comprises setting a state of the selection switch to the first state or the second state.

17. The method of claim 15, wherein the variable load comprises a load and a switch, wherein the load and the switch are connected in parallel, and wherein adjusting the impedance comprises opening or closing the switch.

18. The method of claim 15, wherein determining the orientation comprises determining a tilt of the wireless communication device relative to a vertical direction.

19. The method of claim 15, wherein the first antenna and the second antenna are loop antennas.

20. The method of claim 15, wherein the operating frequency band is one of a plurality of low bands, wherein a high band of the first antenna and the second antenna is substantially independent of the impedance.

* * * * *